United States Patent [19]

Harrison

[11] Patent Number: 4,588,178

[45] Date of Patent: May 13, 1986

[54] HOLD-DOWN DEVICE

[75] Inventor: Leonard Harrison, Clay Center, Kans.

[73] Assignee: Center Engineering, Inc., Clay Center, Kans.

[21] Appl. No.: 745,436

[22] Filed: Jun. 17, 1985

[51] Int. Cl.[4] ..... B25B 1/08

[52] U.S. Cl. ..... 269/234

[58] Field of Search ..... 269/217, 234, 256; 29/251; 254/104

[56] References Cited

U.S. PATENT DOCUMENTS

| | | | |
|---|---|---|---|
| 2,663,151 | 12/1953 | Verderber | 269/234 |
| 3,083,007 | 3/1963 | Campfield | 269/256 |
| 4,027,867 | 6/1977 | Pollington | 269/234 |

FOREIGN PATENT DOCUMENTS

| | | | |
|---|---|---|---|
| 670218 | 4/1952 | United Kingdom | 269/256 |

*Primary Examiner*—Frederick R. Schmidt
*Assistant Examiner*—Judy J. Hartman
*Attorney, Agent, or Firm*—Zarley, McKee, Thomte Voorhees & Sease

[57] ABSTRACT

A hold-down device comprising first and second supports which are secured to an hydraulic shear or the like against vertical movement. First and second shafts are slidably received by the first and second supports and have a hold-down shoe secured to the lower ends thereof. An elongated member is secured and extends between the upper ends of the first and second supports and has a first tubular member slidably mounted thereon. An inclined member has one end secured to the first shaft and its other end secured to the upper end of an upstanding post which is secured to the hold-down shoe. A second tubular member is slidably mounted on the inclined member and is interconnected to the first tubular member by a web. A handle pivotally connects the post and the web so that movement of the handle in one direction causes the hold-down shoe to be lowered and so that pivotal movement of the handle in a direction opposite to the said one direction will cause the hold-down shoe to be raised.

1 Claim, 4 Drawing Figures

HOLD-DOWN DEVICE

BACKGROUND OF THE INVENTION

This invention relates to a hold-down device and more particularly to a hold-down device ideally suited for use with hydraulic shears, etc.

Hydraulic shears or iron workers are frequently used to shear or cut metal plates, bars, etc. The material to be cut is normally placed beneath the shear and held in position by some sort of hold-down device which is normally screwed down into engagement with the material being cut so that the material will remain in position during the cutting or shearing procedure. The conventional hold-down devices are not convenient due to the length of time required to screw the hold-down shoe into position and then screwing the shoe upwardly after the shearing operation.

It is therefore a principal object of the invention to provide an improved hold-down device.

A further object of the invention is to provide a hold-down device which is ideally suited for use with hydraulic shears, iron workers, etc.

A further object of the invention is to provide a hold-down device which may be used with materials having various thicknesses.

Still another object of the invention is to provide a hold-down device which is convenient to use but which positively maintains the workpiece in position.

These and other objects will be apparent to those skilled in the art.

SUMMARY OF THE INVENTION

Figure 1:
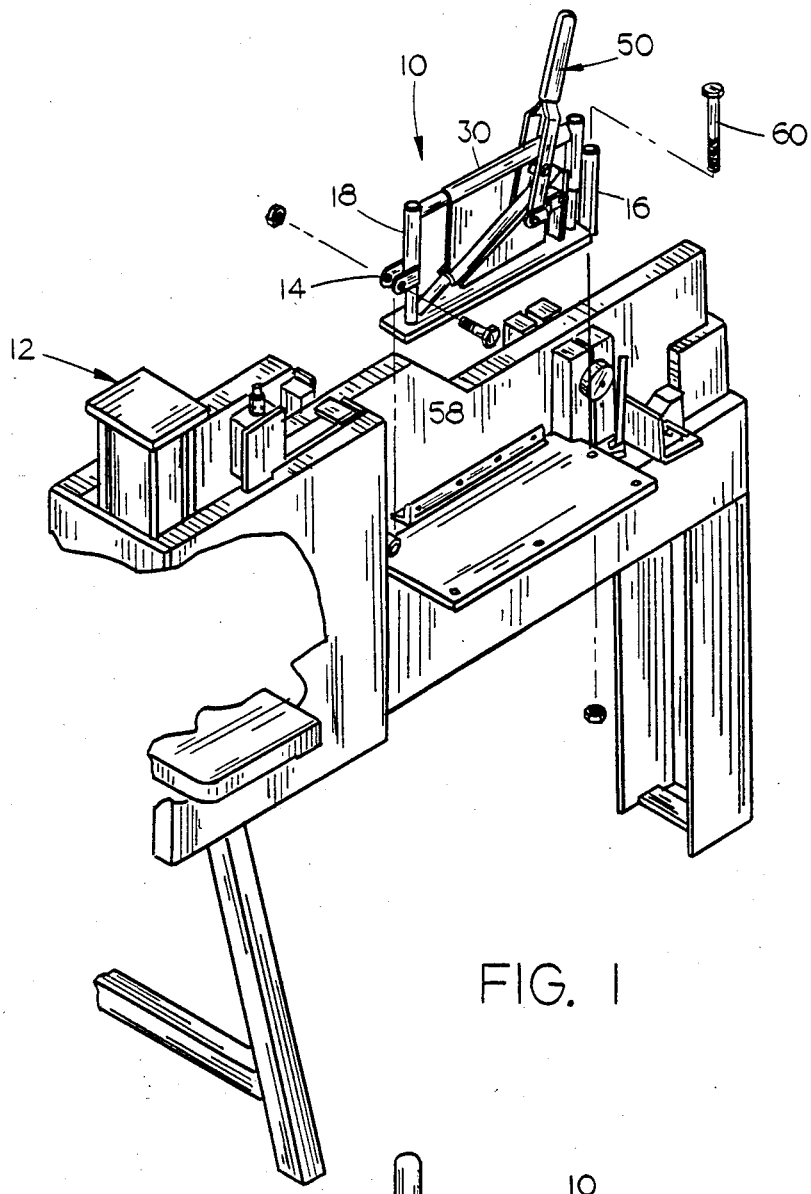
FIG. 1 is a perspective view illustrating the hold-dowm device of this invention utilized on an iron worker.
Figure 2:
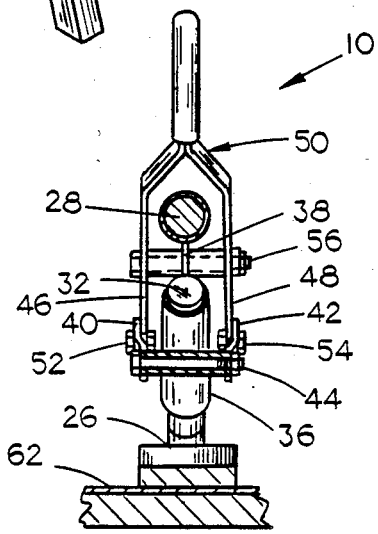
FIG. 2 is a sectional view of the hold-down device as seen on lines 2—2 of FIG. 4.

The hold-down device of this invention includes a pair of supports which are mounted on the frame of the shear or iron worker so that the supports are rigidly mounted against vertical movement. The pair of supports receive vertically disposed shafts which have a hold-down shoe secured to the lower ends thereof. A horizontally disposed support member is secured to and extends between the upper end of the first pair of supports and has a first tubular member slidably mounted thereon. An inclined member has one end secured to the lower end of the third support and its other end secured to a vertically disposed post which extends upwardly from the hold-down shoe. A second tubular member is slidably mounted on the inclined member and is interconnected to the first tubular member by a rigid connection means. A lever assembly is pivotally connected to the upstanding post and the rigid connection means so that pivotal movement of the lever causes the hold-down shoe to be vertically moved.

DESCRIPTION OF THE PREFERRED EMBODIMENT

The hold-down device of this invention is referred to generally by the reference numeral 10 and it is designed to be mounted on a hydraulic shear or iron worker referred to generally by the reference numeral 12. Device 10 includes a bracket 14 and a bushing 16 which are secured to the shear as illustrated to prevent vertical movement thereof.

Vertically disposed sleeves 18 and 20 are secured to the bracket 14 and bushing 16 and slidably receive shafts 22 and 24 therein. A generally horizontally disposed hold-down shoe 26 is secured to and extends between the lower ends of shafts 22 and 24 as seen in the drawings.

A horizontally disposed member 28 is secured to and extends between the upper ends of sleeves 18 and 20 and has tubular member 30 slidably mounted thereon. An inclined member 32 has one end welded or otherwise secured to shaft 22 above shoe 26 and has its other end welded or otherwise secured to the upper end of an upstanding post 35, the lower end of which is secured to shoe 34. Tubular member 36 is slidably mounted on inclined member 32 and is rigidly interconnected to the tubular member 30 by means of web or plate 38.

A pair of spaced-apart links 40 and 42 are pivotally secured at one end to the post 34 by means of bolt 44. The other ends of links 40 and 42 are pivotally secured to the lower ends 46 and 48 of lever or handle 50 by means of bolts 52 and 54, respectively. Handle 50 is pivotally connected to the web 38 by means of bolt 56.

Figure 3:
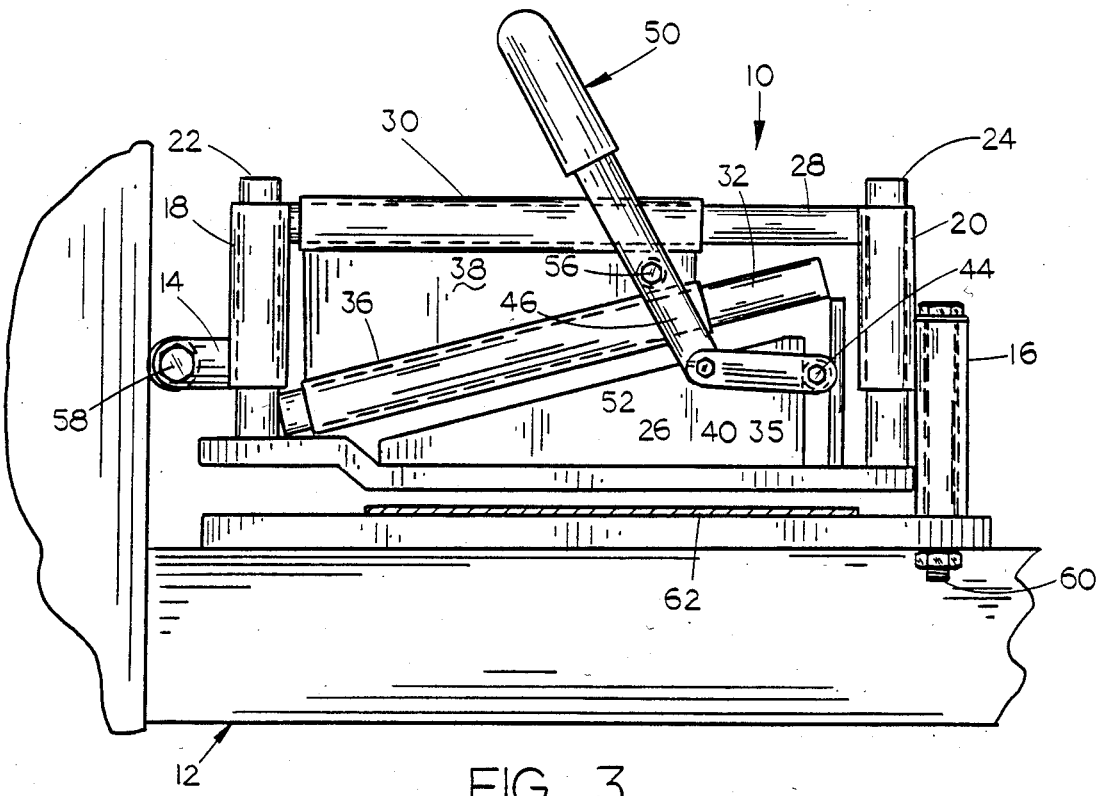
FIG. 3 is a side view of the device in an open or raised position.
Figure 4:
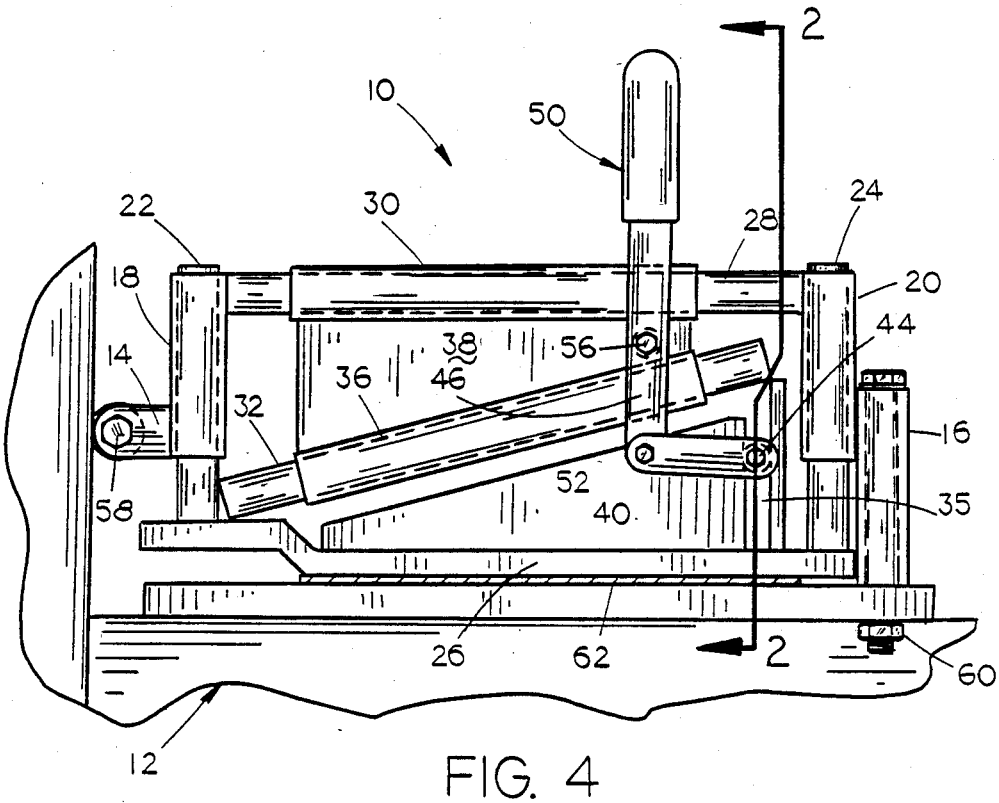
FIG. 4 is side view of the device in a lowered or hold-down position.

In operation, the hold-down device 10 is mounted on the shear 12 by means of bolts 58 and 60 extending through the bracket 14 and bushing 16 respectively. When the handle 50 is in the position illustrated in FIG. 3, the hold-down shoe 26 is in its raised position to enable the material 62 to be cut to be placed therebeneath. Rotation or pivotal movement of the handle 50 from the position of FIG. 3 to the position of FIG. 4 causes the tubular members 30 and 36 to be slidably moved on the members 28 and 32, respectively, which causes post means 35 to be vertically moved downwardly so that the workpiece will be engaged by the shoe 26. The device may accommodate workpieces of different thicknesses and the device will maintain the workpiece beneath the shoe 26 regardless of the thickness of the workpiece due to the pivotal connection between the handle 50 and the web 38 and the post 35. When the device is in its hold-down position, the workpiece will be securely maintained beneath the shoe 26. When the workpiece has been cut, the handle 50 is moved from the position of FIG. 4 to the position of FIG. 3 thereby quickly raising the shoe 26 to enable the workpiece to be removed.

Thus it can be seen that a novel hold-down device has been provided which permits the quick, efficient and positive positioning of a workpiece. It can therefore be seen that the device accomplishes at least all of its stated objectives.

I claim:

1. A hold-down device, comprising, first and second vertically disposed supports having upper and lower ends, means for mounting said supports against vertical movement, third and fourth supports vertically movably mounted in said first and second supports respectively, a first horizontally disposed member secured to and extending between said first and second supports adjacent the upper ends thereof, a substantially horizontally disposed hold-down shoe secured to and extending between the lower ends of said third and fourth supports, a post means secured to said shoe, between said third and fourth supports and adjacent said fourth support, and extending upwardly therefrom, said post means having upper and lower ends, the upper end of said post means terminating below said first member, a second angularly disposed elongated member having one end secured to the upper end of said post means and its other end secured to said third support below said first support, a first tubular member slidably mounted on said first horizontally disposed member, a second tubular member slidably mounted on said second angularly disposed elongated member, rigid connection means connecting said first and second tubular members, a first linkage means, having opposite ends, pivotally secured at one end to said post means below the upper end thereof, a lever member having upper and lower ends, said lever member being pivotally connected, about a horizontal axis, between its ends, to said rigid connection means, said lever member being pivotally connected at its lower end, about a horizontal axis, to the other end of said first linkage means whereby pivotal movement of said lever in one direction will cause said hold-down shoe to be moved downwardly relative to said first and second supports and whereby pivotal movement of said lever in a direction opposite to said one direction will cause said hold-down shoe to be moved upwardly relative to said first and second supports.

* * * * *